US007942358B2

(12) United States Patent
Posti et al.

(10) Patent No.: US 7,942,358 B2
(45) Date of Patent: May 17, 2011

(54) METHOD FOR CONTROLLING A CRUSHER AND A CRUSHER

(75) Inventors: Ari Posti, Rauma (FI); Kari Kuvaja, Toijala (FI); Ilpo Nieminen, Siivikkala (FI); Jarmo Eloranta, Kangasala (FI); Harri Lehtonen, Pirkkala (FI)

(73) Assignee: Metso Minerals Inc., Helsinki (FI)

( * ) Notice: Subject to any disclaimer, the term of this patent is extended or adjusted under 35 U.S.C. 154(b) by 277 days.

(21) Appl. No.: 12/084,376

(22) PCT Filed: Nov. 2, 2005

(86) PCT No.: PCT/FI2005/050391

§ 371 (c)(1),
(2), (4) Date: Apr. 30, 2008

(87) PCT Pub. No.: WO2007/051890

PCT Pub. Date: May 10, 2007

(65) Prior Publication Data

US 2009/0095827 A1 Apr. 16, 2009

(51) Int. Cl.
*B02C 25/00* (2006.01)

(52) U.S. Cl. ..... 241/300; 241/34; 241/36; 241/37

(58) Field of Classification Search ..... 241/30, 241/34, 36, 37, 207–216, 244
See application file for complete search history.

(56) References Cited

U.S. PATENT DOCUMENTS

| | | | | |
|---|---|---|---|---|
| 5,580,003 | A * | 12/1996 | Malone et al. | 241/30 |
| 6,259,222 | B1 | 7/2001 | Kira | |
| 7,591,437 | B2 * | 9/2009 | Nilsson et al. | 241/30 |
| 2006/0243833 | A1 * | 11/2006 | Nilsson | 241/30 |

FOREIGN PATENT DOCUMENTS

| | | | |
|---|---|---|---|
| JP | A 11-188282 | | 7/1999 |
| WO | WO 87/05828 | A1 | 10/1987 |
| WO | WO 02/070137 | A1 | 9/2002 |
| WO | WO 2004/004907 | A1 | 1/2004 |
| WO | WO 2004/004908 | A1 | 1/2004 |
| WO | WO 2005/007293 | A1 | 1/2005 |

* cited by examiner

*Primary Examiner* — Faye Francis
(74) *Attorney, Agent, or Firm* — Oliff & Berridge, PLC

(57) ABSTRACT

A crusher and a method for controlling a crusher having a first crushing member and a second crushing member defining a crusher setting of a crushing cavity into which material to be crushed is being fed. The method having the steps of: measuring continuously instantaneous load on the crusher; recording instantaneous load peaks exceeding a predetermined target level for the load peaks; keeping track of the number of the load peaks exceeding the predetermined target level during a predetermined period of time; and controlling loading of the crusher on the basis of the number of the load peaks experienced by the crusher during the predetermined period of time.

19 Claims, 3 Drawing Sheets

METHOD FOR CONTROLLING A CRUSHER AND A CRUSHER

TECHNICAL FIELD OF THE INVENTION

The present invention relates to a method for controlling a crusher and to a crusher. The present invention further relates to a device for controlling a crusher. In such a crusher, material to be crushed is fed into a gap between a first crushing member and a second crushing member.

BACKGROUND OF THE INVENTION

A crusher type mentioned above is utilized in order to crush hard material, such as pieces of rock material.

It is desirable to be able to crush a large quantity of material in the crusher without risking the crusher being exposed to loads which cause breakdowns. High productivity leads to high crushing forces or high crushing power. Especially, when considering the crushing force and the crushing power, the crusher may be damaged due to frequent peak levels of force and power experienced by the crusher.

Document WO-2005/007293-A1 discloses a method for controlling a crusher. In the method, the instantaneous load on the crusher is measured during a period of time, a reference value representing the highest measured instantaneous load during the period of time is calculated, and the representative value is compared to a predetermined value. On the basis of the results of the comparison, the loading on the crusher is controlled. However, it is difficult to determine the reference value, and therefore unnecessary delays may occur. Also, the representative value does not necessarily show the actual number of the crusher load peaks affecting the control system and structure of the crusher.

Document WO 87/05828 discloses a method to decrease the risk of increased mechanical load and breakdowns. The pressure surges in the hydraulic system are monitored, and when a predetermined value is exceeded, the relative position of the crushing shells is changed and the width of the crushing gap is increased. The disclosed method reduces the risk of the crusher breaking down, but can not be used to improve the performance of the crusher. Additionally, the method disclosed in document WO 87/05828 does not explain how to control the crusher to restore the normal operation after the gap width has been increased.

Furthermore, excessive calculations and the averaging the measured values of power and force to reduce random variation, may result in a delayed response to overload conditions. For example, delays occur due to the way in which averages are calculated by combining the current reading with either a past average value or with a fixed set of past readings. The averaging may also wash out the range of values and so peak levels are ignored and this can cause a problem.

SUMMARY OF THE INVENTION

An object of the present invention is to provide a method for controlling a crusher, which method improves the performance of the crusher in respect of accomplished crushing work in relation to the prior art techniques. Especially, an object of the present invention is to maximize the crushing forces or the crushing power in the crushers. The method is used e.g. in cone crushers or in gyratory crushers.

Furthermore, when considering potential crusher damages and breakdowns, in the cases of high power and force, damage is done by the peak levels experienced by the crusher, and therefore it is best to directly measure the peak values in real time without delay to avoid damage to the crusher. An object of the invention is to minimize the risk of mechanical damage by providing a more quick response in controlling the crusher.

The object of the invention is attained by a method for controlling a crusher, in which method the maximum peak values of characteristics related to the power and/or the force and/or stress are measured and the crusher operation is continually adjusted so that the performance is efficient. As an example, crusher parameter subject to adjusting during the operation may be the crusher setting, the feed rate of the material to be crushed, the speed of the crusher member and the throw of the crushing member, i.e. the mutual movement of the crushing members.

When considering the power and the force and stress, the measured values of a characteristic have a wide random distribution over time and react quickly to changes in the operating parameters such as the crusher setting, the speed and the throw. Other characteristics representing the instantaneous load may also be chosen, e.g. the temperature increase in the bearings, the temperature increase of the hydraulic fluid, vibrations in various parts of the crusher, or acoustic emission. In addition, the feed material characteristics can vary over time, so that an appropriate set of operating parameters one minute can be inappropriate the next minute and result in overloading the crusher. An object of the invention is to maximize the force or the power or stress without frequently exceeding the target level of a chosen characteristic related to e.g. the force. Depending on the application, an object of the invention is to control e.g. the force without frequently exceeding the target level that has been set on a level that is optimal for the current application.

The invention is based on the following: firstly, the instantaneous load on the crusher, or any other characteristic representing e.g. the forces acting on the crusher, is measured continuously; secondly, the load peaks exceeding a predetermined target level are recorded; thirdly, a time period is set, the time period representing a time window during which the number of the load peaks exceeding the predetermined target level is recorded; fourthly, a threshold value is set, the threshold value representing the maximum allowable number of load peaks during the time period already set; fifthly, at least one of the crusher parameters is controlled in an appropriate manner depending on whether the threshold value was exceeded, in which case the load on the crusher is controllably decreased, or not exceeded, in which case the load on the crusher is controllably maintained or increased; sixthly, the procedure is repeated continually for the continued efficient control of the crusher. Variations to the described procedure are allowed.

An advantage of the method is that the predetermined characteristic will be maximized, the characteristic being e.g. the pressure of the controlling hydraulic circuit, the force, the power, stress or any other characteristic mentioned earlier, especially in cone or gyratory crushers but not excluding any other crusher type. A further advantage of the invention is that the control system of the crusher adjusts the operation for reaching the predetermined target level of the chosen characteristic. In this way, the performance of the crusher is improved.

A further advantage of the invention is fast follow-up of process fluctuations, meaning that the targeted characteristic will be maximized even under variable material feed conditions which may result from different feed material gradation, different rock hardness or different rock moisture level. The control system always targets the crusher to operate at its top performance level as defined by the desired characteristic. Furthermore, the method of controlling the crusher is universal to all crushing cavity shapes and maintains maximum performance even with worn wear parts, i.e. crushing members.

The control of the crusher is based on measured load peaks that represent the highest instantaneous loads on the crusher. These load peaks involve the highest risk of mechanical damage on the crusher. Thanks to the invention an operator can be sure that the function of the crusher is not risked, irrespective of how the crusher is used, i.e. how the crusher is supplied with feed material to be crushed. The operator can, irrespective of the quantity of the material, the moisture content of the material, and the size distribution and hardness of the material, decrease the highest instantaneous loads. Thereby, the crusher can operate e.g. at a high average force without increasing the risk of breakdown.

In crushers that are operated so that the supplied material does not cause high load peaks, the method according to the invention makes it possible to operate the crusher at a higher average load, leading to an improved performance and e.g. maximised force of the crusher. In crushers that have an uneven supply of material causing load peaks, the method according to the invention will give a signal to adjust the operation of the crusher system including the crusher itself or the feeding machine or feeding equipment feeding the crusher in order to provide a more efficient crushing.

The target level, i.e. the target value of a chosen characteristic, may be selected so that it presents the highest load that the crusher can operate at without an increased risk of mechanical breakdown. Thus, the crusher can be utilized optimally without increasing the risk of breakdown in cases where the material is supplied unevenly or the material is unusually hard. The target level may be pre-selected or set by the manufacturer of the crusher and the operator is left with the task of, perhaps, adjusting the supply of material with the purpose of improving the performance of the crusher. However, the risk of mechanical damage is low. In most cases it is more appropriate to let the operator to set the target level. This option gives more room for the on-site decisions and calculations concerning the pros and cons of the increased forces in relation to the increased risks of damage, and vice versa. Also, for an improved performance, the target level may be dependent on the application and therefore may be set at a lower level than the level representing the highest load the crusher can operate at. The term application relates to the various processes for crushing the material for achieving the intended quality of the crushed product.

According to a preferred embodiment, a sequence of data is formed, which data consist of measurements of the loads on the crusher in each given periods of time, preferably consecutive. The sequence of data contains data representing the number of the load peaks exceeding the set threshold value during each time period. The division into time periods and setting a threshold value ensures that occasional high load peaks exceeding the target level have a limited influence on the control.

Suitably, characteristic measurements are used continuously during the operation of the crusher for forming the sequence of data. Therefore the control may be based on a continuous supply of real-time data. The control may thereby quickly react on the changes in the operation of the crusher.

The effects of the highest or the lowest values of the data included in the measurements may be excluded e.g. by filtering or exclusion. In this way, it is avoided that the occasional very high or low load values, which may depend on erroneous measurements, or noise caused by the transducers or the system, have undesirable large influence on the control of the crusher.

According to a preferred embodiment, the width of the crushing gap (i.e. the closed side setting of the crusher) is adjustable by means of a hydraulic adjusting device, in which case the characteristic being measured and representing the load is the pressure of the hydraulic fluid in the adjusting device. According to another preferred embodiment, the crusher load is measured as the power of a driving device of the crusher. The power of the driving device may, for instance, be measured directly as electric power, if the driving device is an electric motor, it can be determined on basis of the hydraulic pressure, if the driving device is a hydraulic motor, or, if the driving device is an engine, it can be measured from a developed engine power. Also, according to an another preferred embodiment, the load is measured as a mechanical stress on the crusher. A component of the crusher that is the most critical one for the mechanical strength of the crusher may be chosen for the determination of the mechanical stress, e.g. by using strain gauges. During any period at least one of the crusher parameters may be controlled depending on a measured characteristic, i.e. the hydraulic pressure, the power, stress, or any other characteristic mentioned earlier, or any combination of these. In this way the crusher operates without a risk of damage on a particular component, for instance the hydraulic system, the driving device or the various crushing members, which are exposed to loads.

According to a preferred embodiment, the load on the crusher is controlled so that the width of the crushing gap in the crushing cavity is changed, i.e. the crusher setting is changed, the supply of material to the crushing chamber is changed, the rotational speed of the crusher driving device is adjusted, the mutual movement of the crushing members, i.e. the throw, is adjusted, or by means of any other known control method. The control of the crusher load may take place in various ways and the method according to invention may be adapted to the current operational situation and the application. A change in the crusher setting gives a very quick response. In other cases it may be more desirable to keep the crusher setting constant, and therefore the supply of material is adjusted. Also, it may be more suitable to adjust the rotational speed of the driving device and to alter the mutual movement of the crushing members.

BRIEF DESCRIPTION OF THE DRAWINGS

The invention set forth will be described by means of embodiments with reference to the appended drawings.

DETAILED DESCRIPTION OF THE INVENTION

Figure 1:
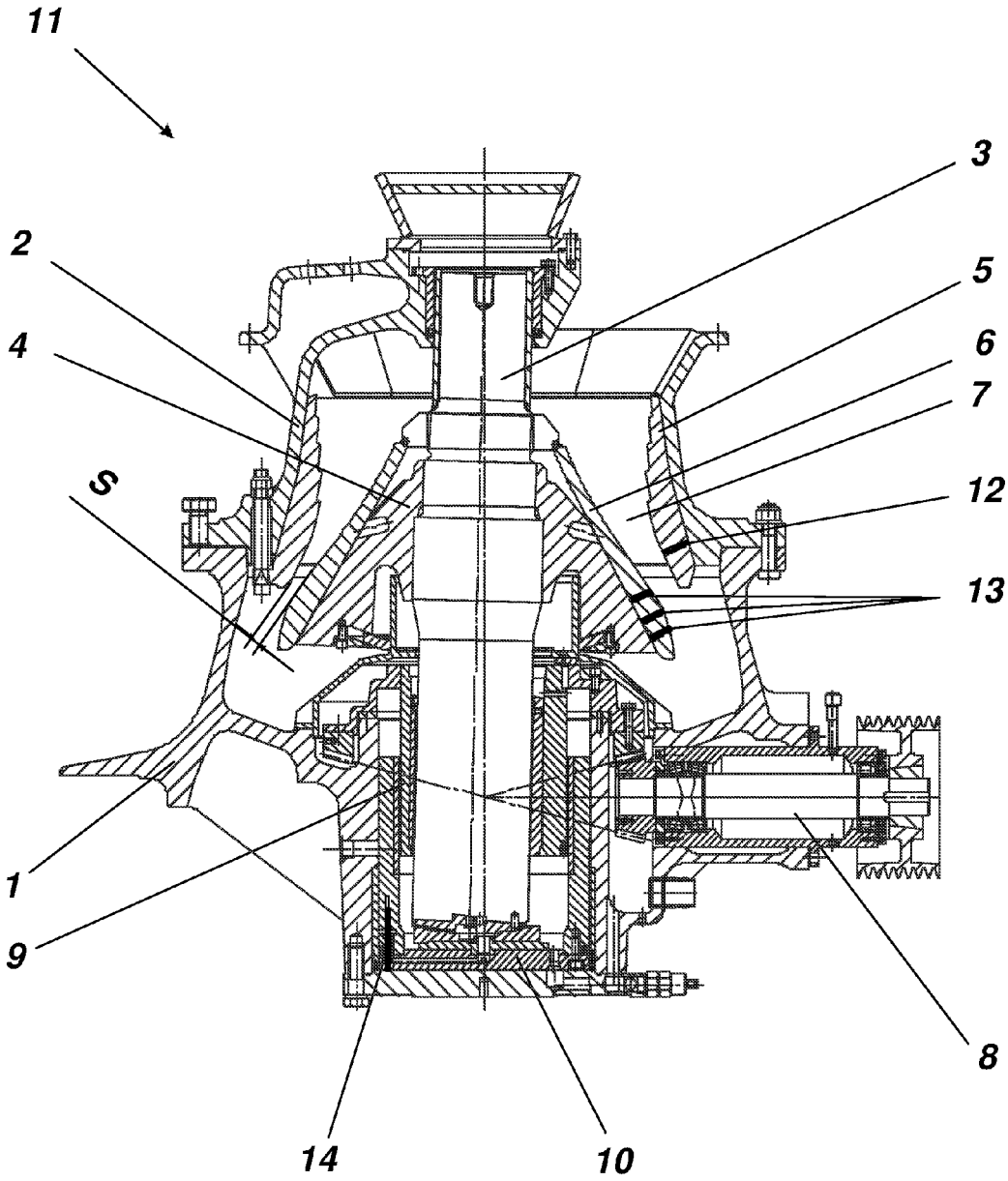
FIG. 1 schematically shows a gyratory crusher.

In FIG. 1, a crusher, particularly a cone crusher is shown schematically. The crusher 11 has a frame consisting of a lower frame 1 and a upper frame 2. The upper frame 2 is provided with an outer crushing member 5. The supporting cone 4 (i.e. the crushing head) fixed to the main shaft 3 is provided with an inner crushing member 6. The outer crushing member 5 surrounds the inner crushing member 6 and forms a crushing cavity 7 into which the material to be crushed is fed from above. The lower frame 1 is provided with a countershaft 8 which drives an eccentric shaft 9. The main shaft 3 is connected eccentrically to the eccentric shaft 9 so that the main shaft 3 oscillates when the eccentric shaft 9 is driven by the countershaft 8. The countershaft 8 is driven by a driving device, typically an electric motor.

Between the inner crushing member 6 and the outer crushing member 5, the crushing cavity 7 is formed, which decreases in width downwards. The supporting cone 4 and thereby the inner crushing member 6 are vertically movable by means of a hydraulic adjusting device 10 the position of which is read by a sensor 14. The hydraulic adjusting device 10 is typically an actuator controlled by pressure. The reading of the sensor 14 is proportional to the width of the cavity 7 and the wear of the crushing members is compensated by the hydraulic adjusting device 10 comprising a cylinder/piston pair. The wear of the crushing members 5 and 6 is measured with sensors 12 and 13, respectively.

The position sensing arrangement or the wear sensing arrangement is known as such and examples are disclosed in publications WO 2004/004907 A1 and WO 2004/004908 A1.

Figure 2:
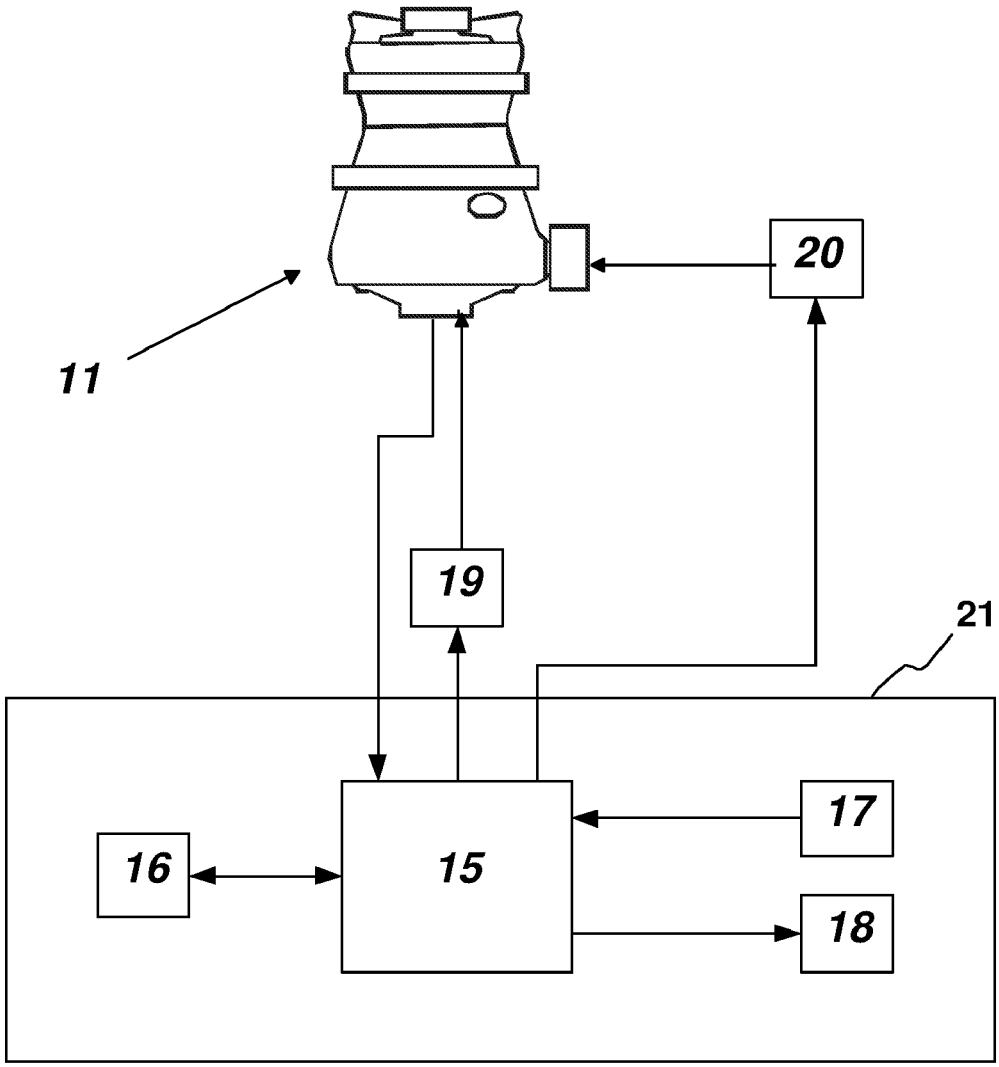
FIG. 2 schematically shows the control system of a crusher.

In operation, the crusher is controlled by a control device 21, controlled by a control algorithm, shown in FIG. 2 and comprising a central processing unit 15, a memory unit 16, an input device 17, e.g. a keyboard, and a display device 18. Furthermore, the crusher 11 has an actuator 19 for controlling the crusher setting S (see FIG. 1), and a driving device 20. The actuator 19 and the driving device 20 may be of hydraulic, electrical or mechanical type. The central processing unit 15 signals the actuator 19 for controlling the crusher setting S. Furthermore, the central processing unit 15 may be connected to the driving device 20 for controlling the starting, the stopping and the speed of the driving device 20.

When the crusher is in operation, a suitable crusher setting S is set and a supply of material to the crushing cavity 7 begins. The supplied material is crushed in the cavity 7 and may then be collected vertically below the same.

According to the present invention, the highest instantaneous loads on the crusher are measured.

In the present application, the term load relates to the loading that the crusher is exposed to on a certain occasion. The load may, for instance, be expressed in the form of a peak hydraulic pressure, which is experienced by the actuator 19 and measured by a pressure gauge. The load may also be expressed as a peak motor power, which is experienced by the driving device 20 and measured by a transducer. Furthermore, the load may also be expressed as a peak stress that is estimated by measuring the mechanical stresses in the crusher using e.g. strain gauges.

Figure 3:
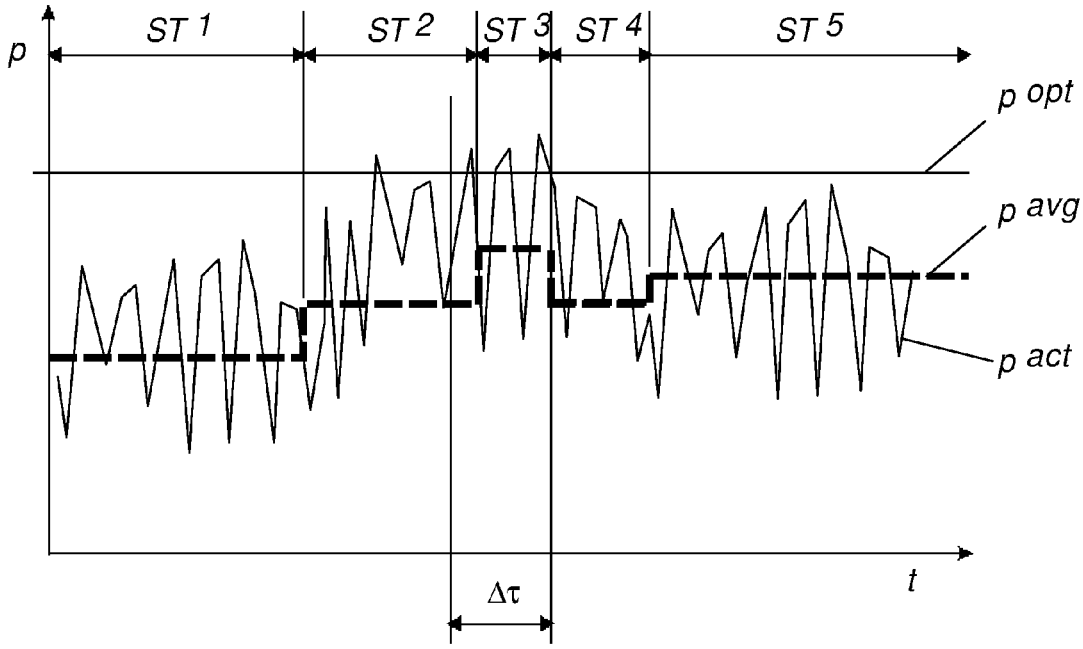
FIG. 3 schematically shows a sequence of measurements on the load of the crusher during the control of the crusher.

FIG. 3 shows a method for controlling the operation of the crusher depending on the hydraulic fluid peak pressure. On the basis of the following description, the control based on another characteristic, e.g. stress or the power, may be realised using the same principles. The crushing process results in a varying pressure in the hydraulic fluid. With a material of a certain hardness and particle size distribution, a small crusher setting S will mean a high hydraulic fluid pressure and efficient use of the crusher for crushing the supplied material, and a wide crusher setting S will mean a low hydraulic fluid pressure. The crusher setting S is dependent on the application. The object is to keep the average pressure at an optimal level or as high as possible without risking the crusher to be damaged mechanically.

The measurement of the pressure in the hydraulic fluid circuit, preferably the adjusting pressure in the adjusting device, takes place by a pressure transducer. The measurement of the adjusting pressure continues typically as long as the crusher is in operation and material is supplied into the crusher. The signal from the pressure transducer is received by the control device.

According to a detailed embodiment, the measurement is conducted as follows. The adjusting pressure $p_{act}$ is measured approximately 8 times per every program cycle of approximately 10 ms. It is clear that the parameters mentioned above may have a different setting. Thereafter, an average value $p_{avg}$ of these measurements is displayed and/or signalled. The control procedure and related measurements may start after a certain delay after the start of the crushing or at a given moment of time.

Control of the crusher may be based on filtered signals. Typically 1 Hz low pass filter is used to filter the measurement data. If the low-passed measurement signal is too high or too low during a predetermined period of time, typically 2 seconds, adjustment is made and the crusher setting S is changed accordingly.

The control based on counting the load peaks takes place as follows. The criteria for a load peak is such that the measured adjusting pressure $p_{act}$ must be higher than a set predetermined value which in this case is the same as the target level $p_{opt}$. Additionally the measurement qualifies as a load peak if the target level is exceeded longer than a predetermined value, which is typically, but not necessarily, 30 ms. Any other suitable time frame may be used.

The control device functions in various modes. The target of the "setting mode" is to keep the crusher setting constant. The aim of the "load mode" is to keep either the power or the adjusting pressure at a set level all the time. "Manual mode" means that the operator adjusts the crusher manually. In the following description the "manual mode", the "load mode" and the "setting mode" are explained using an example.

Firstly, the crusher setting S has a pre-set value, which the control tries to maintain. The criteria for changing the crusher setting S is defined so that after a predetermined number of load peaks N1, i.e. high pressure peaks of the adjusting pressure $p_{act}$, during a first period of time T1, the crusher setting S is increased, i.e. the crusher setting is opened wider. The first period of time T1 equals to Delta t in FIG. 3. The first period of time T1 and the number of load peaks N1 are variables to be set. The change I1 of the crusher setting S is also a variable to be set. As an example, if 3 load peaks are experienced during 3 seconds, the crusher setting S is increased by 1 mm. Furthermore, only in the "setting mode", if new load peaks do not occur during a second period of time T2 (e.g. 3 seconds) or the number of the load peaks do not reach another predetermined value, the crusher setting S is again decreased, i.e. the crusher setting is tightened smaller by a predetermined value, typically, but not necessarily, by 1 mm. Any other suitable decrement may be used. The first period of time T1 having load peaks resulting in a change in the crusher setting S and the second period of time T2 are consecutive time periods.

Thus, if the maximum amount of load peaks occurs during the first period of time T1 or the second period of time T2, the crusher setting S is again increased, typically, but not necessarily, by 1 mm. Any other suitable increment may be used.

Furthermore, only in the "setting mode", if load peaks do not occur during the first period of time T1 or the second period of time T2, the crusher setting S is again decreased during the second period of time T2 by a predetermined amount, typically, but not necessarily, 1 mm, until the crusher setting S has reached its pre-set value. Any other suitable decrement may be used. Also, in the "setting mode" only, if the number of the increases of the crusher setting S during a third period of time T3 exceeds a predetermined value, the crusher setting S is increased, typically, but not necessarily, 5%. Any other suitable percentage may be used.

In the "load mode" the crusher setting S is increased immediately if the number of the load peaks, i.e. the adjusting pressure peaks, exceeds a predetermined value during the first period of time T1. After this, the crusher setting S is maintained during the second period of time T2 that follows the first period of time T1. If the number of the load peaks is again exceeded during the first or second period of time, the crusher setting S is again increased. However, if load peaks do not occur during the second period of time T2, the crusher is controlled using the normal power and pressure limits again, which are being set to system as preferable maximum operation values.

In the "load mode", if the number of the changes of the crusher setting S during a third period of time T3 exceeds a predetermined value, the control device is switched to the "setting mode". The number of the changes of the crusher setting S is a variable to be set, typically, but not necessarily, having the value of 3. The third period of time T3 is typically, but not necessarily, set to 3 minutes. Any other suitable values and time frames may be used.

FIG. 3 shows a curve of measured hydraulic fluid pressure $p_{act}$. FIG. 3 is an example of the adjustment conducted according to the present invention. The average $p_{avg}$ and peak values $p_{act}$ of the predetermined characteristic, e.g. the pressure of the system, are being measured. The purpose of the adjustment system comprising the adjusting device is to adjust the crusher operation by changing the values of operating parameters of the crusher, such as crusher setting, feed rate, speed and throw (i.e. the eccentric movement) so long as the peak load level reaches but does not frequently exceed a predetermined level, namely the target level $p_{opt}$. As an example, at the first stage ST1 the crusher is clearly underloaded, and thus the adjustment system starts to adjust, in this case, and to reduce the crusher setting, and as time passes to the second stage ST2, the load peak level of the predetermined characteristic will increase. At the point when in a given timeframe or a period of time $\Delta t$ there are enough load peaks exceeding the target level—during the stages ST2 and ST3—the crusher setting will be adjusted in the opposite way as before to increase the crusher setting to reach an acceptable level of $p_{act}$ at stage ST4. This causes the load peak maximums to drop below the target level $p_{opt}$ and the adjustment system will again start to adjust the crusher setting to a smaller value at stage ST5 in order to find the level where load on the target level will be realized without being exceeded frequently.

As a result the chosen, predetermined crusher characteristic will be maximized, because the system is always adjusting the crusher to reach the target level of the characteristic.

In its most simple form the control device in accordance with the invention gives the operator information of the state of the crusher, e.g. on the display device, and leaves the decision of how to adjust the crusher to the operator. For example, the control device may display the average pressure $p_{act}$ and the target pressure $p_{opt}$. At the same time the control device may give the user information of whether the device has detected a harmful number of pressure peaks or not. Also the actual number of harmful peaks may be presented. The information to the operator may be either audible or visual. The audible or visual signal may be given to the operator by a device connected to the control device.

The invention is not limited to any given type of crusher. Instead it may be adapted to e.g. jaw crushers, impact crushers, hammer mills, shredders or any other kind of crushers, whose characteristics can be monitored and whose parameters can be controlled. Neither is the invention limited to any particular sort of crusher's power transmission; the crusher may be hydraulically, electrically or mechanically powered.

Further, the invention is not limited to any particular measuring or transducer technology. Instead, all types of transducers that are capable of submitting sufficient information of the characteristics and crusher parameters for the control system of the crusher may be utilized.

It is obvious to the person skilled in the art that the invention is not either limited to any particular feed material. In addition to rock material the feed material may be any hard material having physical properties close to rock, for example gravel, ore, coal, bricks, asphalt, concrete, ceramics, glass etc.

The invention is not limited to the examples or the embodiments described above, but may vary according to the enclosed claims.

The invention claimed is:

1. A method for controlling a crusher comprising a first crushing member and a second crushing member defining a crusher setting of a crushing cavity into which material to be crushed is fed, the method comprising:

measuring continuously an instantaneous load on the crusher;

recording instantaneous load peaks exceeding a predetermined target level for load peaks;

counting a number of the instantaneous load peaks exceeding the predetermined target level during predetermined periods of time; and controlling loading the crusher on a basis of the number of the instantaneous load peaks experienced by the crusher during the predetermined periods of time, wherein the loading of the crusher is decreased if the number of the instantaneous load peaks exceeds a predetermined value during a first predetermined period of time, and wherein the loading of the crusher is increased again if the number of the instantaneous load peaks does not reach another predetermined value during a second predetermined period of time.

2. The method according to claim 1, further comprising:

further controlling the loading of the crusher on the basis of the number of the instantaneous load peaks, wherein the loading of the crusher is increased again if the number of the instantaneous load peaks does not reach the another predetermined value during a third predetermined period of time, and wherein the loading of the crusher is decreased again if the number of the instantaneous load peaks exceeds the predetermined value during a fourth predetermined period of time.

3. The method according to claim 2, further comprising:

increasing and decreasing the crusher setting until a pre-set value is reached.

4. The method according to claim 2, further comprising:

keeping track of an average level of the instantaneous load;

displaying or signalling the average level of the instantaneous load to an operator for comparison with the predetermined target level.

5. The method according to claim 1, further comprising:

increasing and decreasing the crusher setting until a pre-set value is reached.

6. The method according to claim 1, further comprising:

keeping track of an average level of the instantaneous load;

displaying or signalling the average level of the instantaneous load to an operator for comparison with the predetermined target level.

7. The method according to claim 1, further comprising:

adjusting the crusher manually.

8. The method according to claim 1, further comprising:

increasing the loading of the crusher by restoring the loading of the crusher dominating prior to the decrement of the loading of the crusher if the number of the instantaneous load peaks does not exceed the predetermined value during the second predetermined period of time.

9. The method according to claim 1, further comprising:

controlling the loading of the crusher by adjusting at least one of the crusher setting, feed rate of the supplied material, speed of the crusher or throw of the crusher.

10. The method according to claim 1, further comprising:

choosing the predetermined target level such that an average level of the instantaneous load is continually maximized but continuous overload of the crusher is minimized.

11. The method according to claim 1, wherein the instantaneous load on the crusher is represented by a measured characteristic of the crusher.

12. The method according to claim 11, wherein the measured characteristic is at least one of stress, a force acting on the crusher, a pressure in a control system of the crusher or a power of a driving device of the crusher.

13. The method according to claim 11, wherein the measured characteristic is at least one of vibration, temperature or acoustic emission.

14. A crusher, comprising:

a first crushing member and a second crushing member defining a crusher setting of a crushing cavity into which material to be crushed is being fed;

a control device for controlling the crusher; and a transducer for continuous measuring of instantaneous load on the crusher;

wherein the control device is configured to:

record instantaneous load peaks exceeding a predetermined target level for the load peaks;

count a number of the instantaneous load peaks exceeding the predetermined target level during predetermined periods of time; and control loading of the crusher on the basis of the number of the instantaneous load peaks experienced by the crusher during the predetermined periods of time, wherein the loading of the crusher is decreased if the number of the instantaneous load peaks exceeds a predetermined value during a first predetermined period of time, and the loading of the crusher is increased again if the number of the instantaneous load peaks does not reach another predetermined value during a second predetermined period of time.

15. The crusher according to claim 14, wherein the control device is further configured to:

keep track of an average level of the instantaneous load; and display or signal the average level of the instantaneous load to an operator for comparison with the predetermined target level.

16. The crusher according to claim 15, wherein the control device is further configured to control the loading of the crusher by adjusting at least one of the crusher setting, feed rate of the supplied material, speed of the crusher or throw of the crusher.

17. The crusher according to claim 14, wherein the instantaneous load on the crusher is represented by a measured characteristic of the crusher.

18. The crusher according to claim 17, wherein the measured characteristic is at least one of stress, a force acting on the crusher, a pressure in a control system of the crusher or the power of a driving device of the crusher.

19. The crusher according to claim 17, wherein the measured characteristic is at least one of vibration, temperature or acoustic emission.

* * * * *